United States Patent [19]

Bouplon

[11] Patent Number: 4,662,457

[45] Date of Patent: May 5, 1987

[54] REVERSIBLE UNDERGROUND PIERCING DEVICE

[75] Inventor: Edward J. Bouplon, Streetsboro, Ohio

[73] Assignee: Allied Steel & Tractor Products, Inc., Solon, Ohio

[21] Appl. No.: 662,958

[22] Filed: Oct. 19, 1984

[51] Int. Cl.[4] ..... E21B 11/02

[52] U.S. Cl. ..... 173/91; 175/19

[58] Field of Search ..... 173/19, 91, 134, 137; 175/19; 91/234, 277; 92/13.4, 13.6

[56] References Cited

U.S. PATENT DOCUMENTS

| | | | |
|---|---|---|---|
| 3,407,884 | 10/1968 | Zygmunt et al. | 173/91 |
| 3,705,633 | 12/1972 | Sudinishnikov et al. | 173/91 |
| 3,727,701 | 4/1973 | Sudnishnikov et al. | 173/91 |
| 3,756,328 | 9/1973 | Sudinishnikov | 173/91 |
| 3,920,086 | 11/1975 | Goppen et al. | 173/139 |
| 3,995,702 | 12/1976 | Klimashko et al. | 173/91 |
| 4,078,619 | 3/1978 | Sudnishnikov et al. | 173/91 |
| 4,132,277 | 1/1979 | Tupitsyn et al. | 173/91 |

*Primary Examiner*—Frank T. Yost
*Assistant Examiner*—Hien H. Phan
*Attorney, Agent, or Firm*—Lyon & Lyon

[57] ABSTRACT

A reversible pneumatic underground piercing tool of the type having a reciprocating striker with the impact of the striker on the front or the rear of the tool being controlled by the longitudinal position of a valve element in the tool. An interengaging pin and slot arrangement in the tool defines the longitudinal the valve element which is positively maintained in the selected position by the supplied air pressure. The longitudinal position of the valve element may be changed for reversing the direction of movement of the tool by interrupting the compressed air supply and rotating the air supply hose a small amount in one direction or the other to reposition the pin in the slot.

30 Claims, 22 Drawing Figures

REVERSIBLE UNDERGROUND PIERCING DEVICE

This invention relates to a pneumatically operated underground piercing device and in particular to an improved mechanism for selecting the forward and reverse direction of operation of the device.

In recent years, pneumatically operated devices have been developed for creating a hole in the ground by the internal mechanism of the bullet-shaped device causing forwardly directed impacts to advance the device by compressing the soil to form the hole. The device is merely connected by a hose to a source of compressed air and aimed in the desired direction whereupon it is self-propelled through the earth to the desired destination. These devices are particularly useful in forming a generally horizontal hole under a street or other surface obstruction to install pipes, cables or the like without the necessity of digging a trench across the obstructed surface or the problems in boring a hole. A small trench is dug on either side of the surface obstruction and this pneumatically operated device is aimed from one trench to the other beneath the surface obstruction. On occasion the device will encounter an obstruction or be diverted so far off course that it is desirable or required to retract the device and start again which requires the ability to reverse the direction of the impacts being created within the device. Also, if a vertical or other blind hole is being created by the device, it is necessary to reverse its direction of movement after reaching the desired hole depth.

A number of different mechanisms and methods have been developed for selectively controlling the direction of movement of these underground piercing tools but each has exhibited some undesirable characteristics for accomplishing reversing such as inconsistency, time consuming, failure, inadvertent switching, excessive maintenance, etc. The mechanisms for accomplishing reversing have taken many forms, although the basic structure performs the same function in each device of communicating the compressed air between an internal control sleeve or valve and the reciprocating striker at two different longitudinal locations within the device to cause the striker to impact either the front end or rear end of the device depending on that longitudinal location.

For example, in U.S. Pat. No. 3,744,576 the longitudinally movable valve sleeve is switched to the reverse operating position by reducing the pressure of the compressed air supplied to the device causing a valve element to move. In U.S. Pat. No. 3,756,328 the valve sleeve is threadedly mounted in the device and connected to the air hose whereby its longitudinal position is changed by rotating the air hose which is a time consuming and difficult job in view of the multiplicity of revolutions required to change the longitudinal position the desired amount and the length of air hose involved. The device of U.S. Pat. No. 4,121,672 has a valve sleeve with a stepped shape at its front edge whereby only a small angular rotation, such as one quarter turn, is required for reversing but in practice it has been found that the mechanism will inadvertently reverse due to unwinding or twisting of the hose. The devices of U.S. Pat. Nos. 4,078,691 and 4,171,727 are reversible by interrupting the air pressure and pulling on the hose to reposition the valve sleeve before reapplying the air pressure, but such devices suffer from inconsistent operation or wear and failure of the components required to hold the valve sleeve in the forward or reversed positions. Numerous other devices have been designed that use one of these principles or methods for causing reversing but have similar deficiencies, such as the devices disclosed in U.S. Pat. Nos. 3,616,865; 3,651,874; 3,705,633; 3,727,701; 3,763,939; 3,995,702; 4,132,277 and 4,284,147.

It is an object of this invention to provide an underground piercing tool with an improved reversing mechanism operable by merely interrupting the air pressure supply and turning the air hose in one direction or the other a small but uncritical amount in either direction for causing the desired direction of movement before resupplying the compressed air which mechanism is not susceptible to inadvertent reversing of the direction of operation or other deficiencies of the prior art devices.

Another object of this invention is to provide an underground piercing tool wherein the valve sleeve is locked in either of two longitudinal positions for the two directions of operation by the supply of compressed air with the change of those positions being readily accomplished by interrupting the supply of compressed air and merely rotating the air hose in one direction or the other a small amount. A still further object of this invention is to provide such a mechanism wherein there are no moving parts for locking the valve sleeve in either longitudinal position.

Another and more detailed object of this invention is to provide a shock absorbing mechanism for supporting the valve sleeve which does not require rubber components that tend to adversely effect the operation of the device by improper installation, inconsistent hardness, or fatigue. A still further detailed object of this invention is to provide sound attenuating means within the underground piercing tool to reduce the noise caused by the compressed air exhaust.

Other and more detailed objects and advantages of the present invention will be apparent to those skilled in the art from the following description and the accompanying drawings, wherein.

Figure 11:
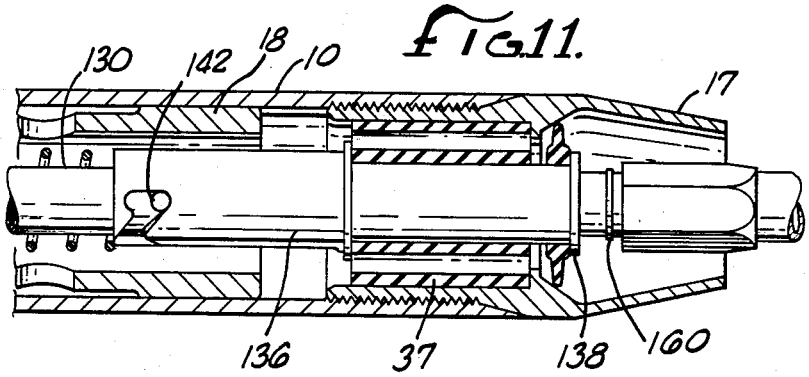
Figure 12:
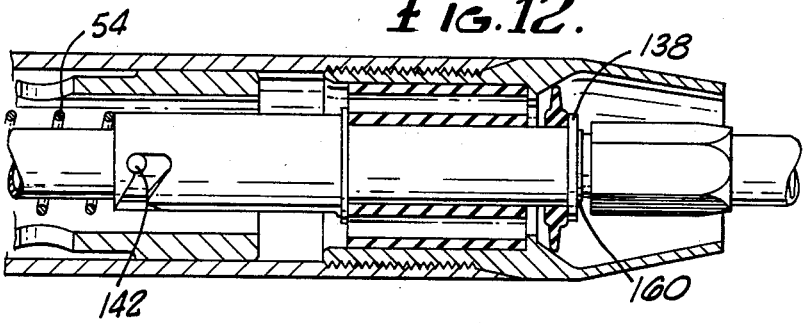
Figure 13:
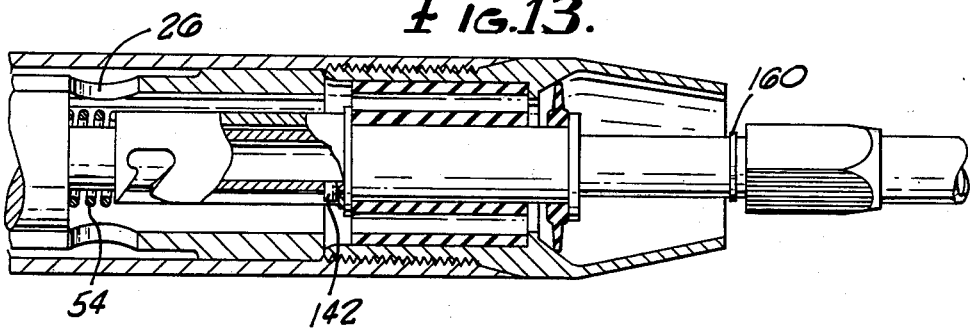

FIGS. 11, 12 and 13 are fragmentary sectional side views of a second embodiment of the underground piercing tool of this invention with FIG. 11 illustrating the components in the position for forward movement of the tool, FIG. 12 illustrating the components in the position upon interrupting the compressed air supply, and FIG. 13 illustrating the components in the position for reverse movement of the tool.

Figure 14:
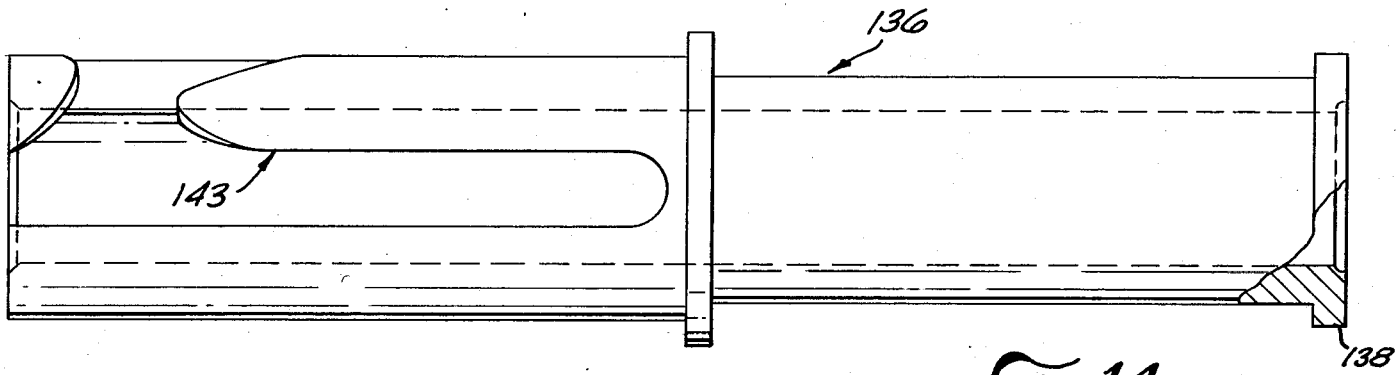

FIG. 14 is a side elevation view of the valve guide sleeve of the embodiment of FIGS. 11–13.

Figure 15:
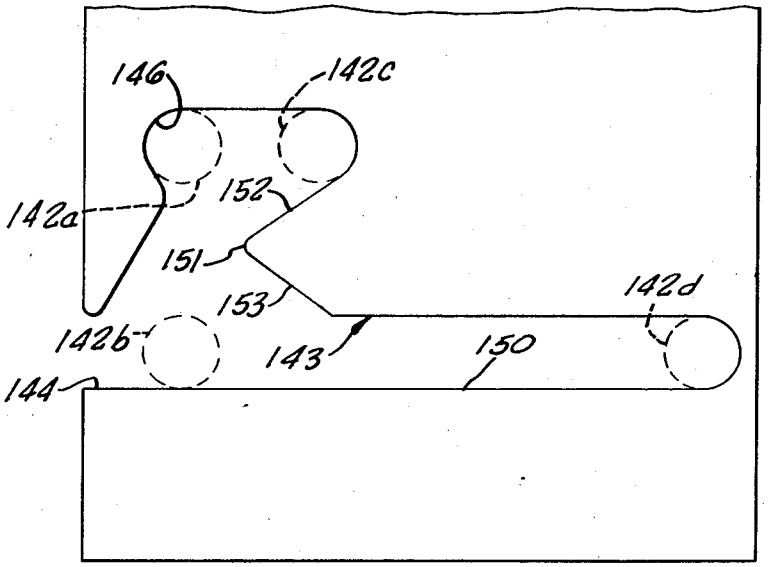

FIG. 15 is a developed view of the guide slots of the valve guide sleeve FIG. 14.

Figure 16:
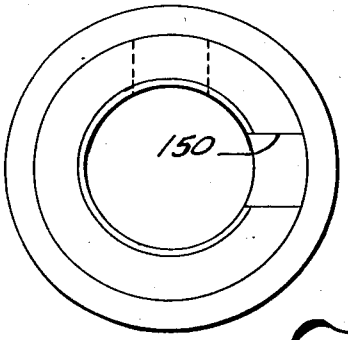

FIG. 16 is a front (left) end view of the valve guide sleeve of FIG. 14.

Figure 17:
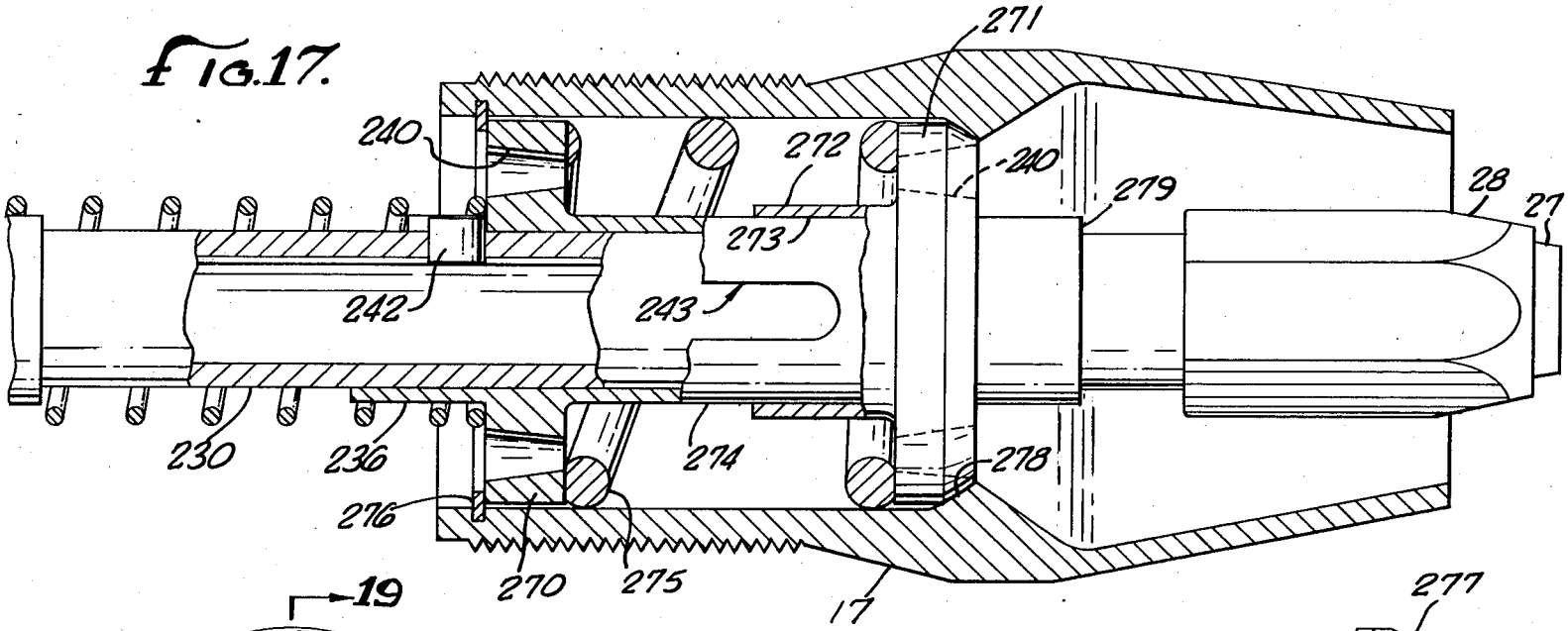

FIG. 17 is a fragmentary sectional elevation view of a third embodiment of the control components of the underground piercing tool of this invention.

Figure 18:
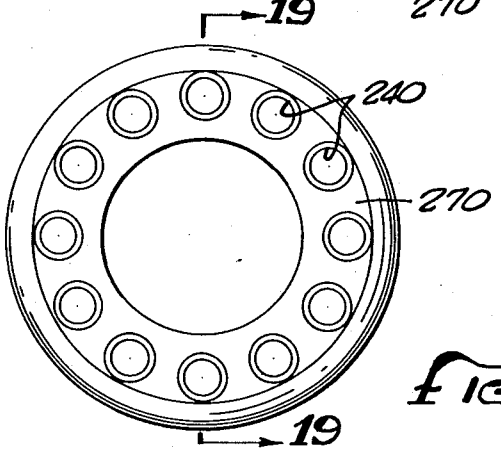

FIG. 18 is an end elevation view of the rear support flange of the embodiment of FIG. 17.

Figure 19:
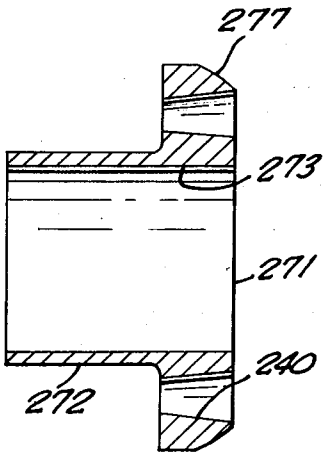

FIG. 19 is a sectional side view of the support flange of FIG. 18 taken on the line 19—19 in FIG. 18.

Figure 20:
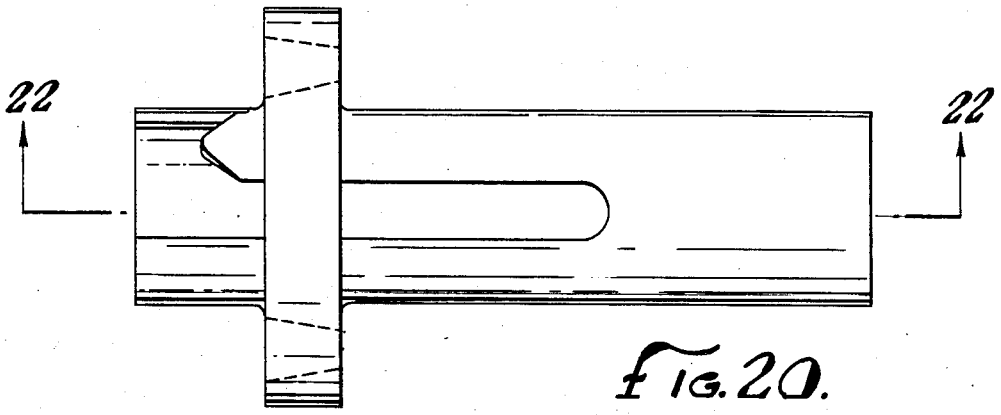

FIG. 20 is a side elevation view of the valve guide sleeve of the third embodiment illustrated in FIG. 17.

Figure 21:
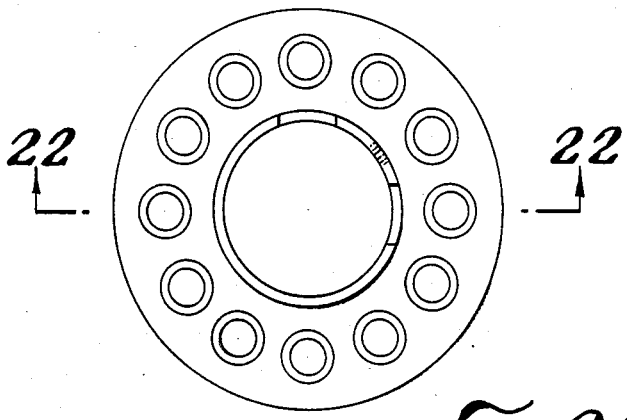

FIG. 21 is a front (left) end view of the valve guide sleeve of FIG. 20.

Figure 22:
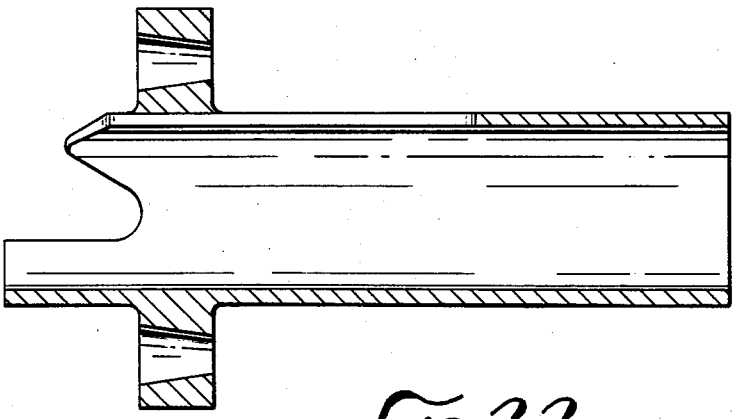

FIG. 22 is a sectional side elevation view of the valve guide sleeve taken on the line 22—22 in FIGS. 20 and 21.

Figures 1, 2, 3:
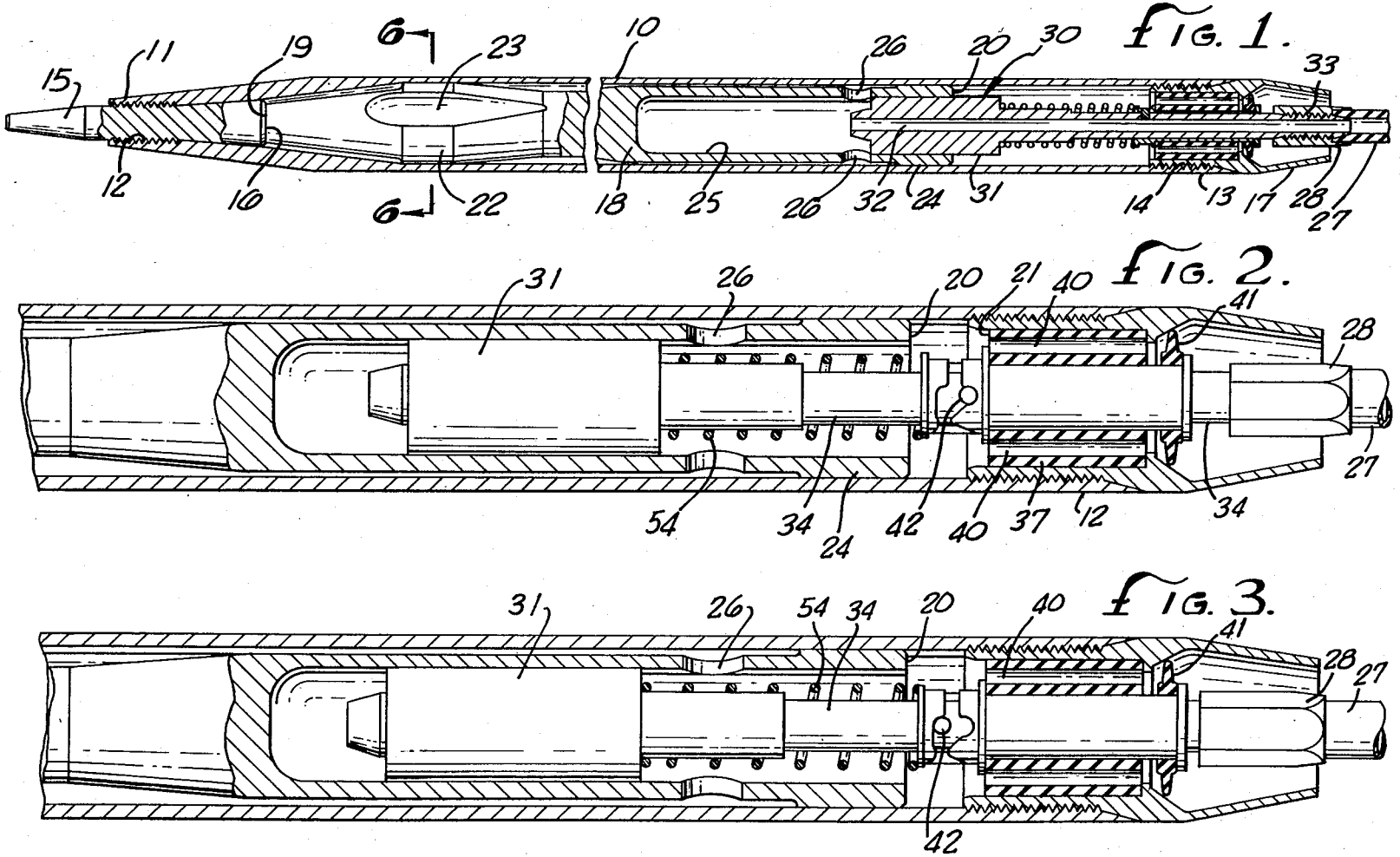
FIG. 1 is a sectional side view of a first embodiment of the underground piercing tool of this invention illustrating the valve sleeve element in the forward position for operation of this tool in the forward direction and with the striker impacting on the front of the tool for imparting forward motion.
FIG. 2 is an enlarged sectional side view of the tool of FIG. 1 with portions in elevation and rotated from the positions illustrated in FIG. 1.
FIG. 3 is a sectional side view similar to FIG. 2 with the components in a position caused by interrupting the supply of compressed air.

Referring now to the first embodiment of this invention illustrated in FIGS. 1–10 and specifically to FIG. 1, the underground piercing tool of this invention includes a hollow cylindrical body 10 having a tapered front end 11 with internal threads 12 and an open rear end 13 with internal threads 14. A pointed anvil 15 is threadedly joined to the threaded front portion 11 by the thread 12 and has a striking surface 16 at its rear end. An end cap 17 is threadedly connected to the rear end 13 of the hollow cylindrical body 10 by the threads 14 for allowing assembly and disassembly of the tool. A striker 18 is slidably mounted in the hollow body 10 to reciprocate fore and aft with a front end surface 19 for impacting on the surface 16 of anvil 15 to drive the tool forwardly. The striker 18 has an annular rear end 20 adapted to impact against the front annular end 21 of the end cap 17 for driving the tool rearwardly. The outer surface of the striker 18 near the front is provided with cylindrical portions 22 for smooth engagement with the interior cylindrical surface of the body 10 and machined flat portions 23 for allowing air to pass that portion. The rear end of the striker 18 is provided with a cylindrical portion 24 slidably engaging the interior of the hollow cylindrical body 10 and acting as a piston and cylinder arrangement. The remaining exterior portions of the striker 18 are spaced from the interior of the cylindrical body 10 to provide annular passageways for the air during operation of the device.

The striker 18 is provided with a cylindrical cavity 25 at its rear end with radial ports 26 communicating the cavity 25 with the exterior of the striker. A valve body, generally designated 30 has a cylindrical valve element 31 at its front end slidably engaging the cylindrical cavity 25 in the striker 18. Valve body 30 has a central bore 32 extending its entire length and a threaded rear end 33 to which an air hose 27 and coupling 28 are connected for supplying compressed air through the body 30 to the cavity 25 of the striker 18. As the striker 18 reciprocates within the body 10 causing the striker cavity 25 to reciprocate over the valve element 31, the ports 26 of the striker are either closed by the valve element 31 or positioned to the front or rear of the valve element 31. The longitudinal position of the valve element 31 determines whether the underground piercing tool will be operating in a forward or reversed mode by timing the opening and closing of the ports 26 to cause the striker to impact at the front surface 16 on the anvil or the rear surface 21 on the end cap.

Figure 4:
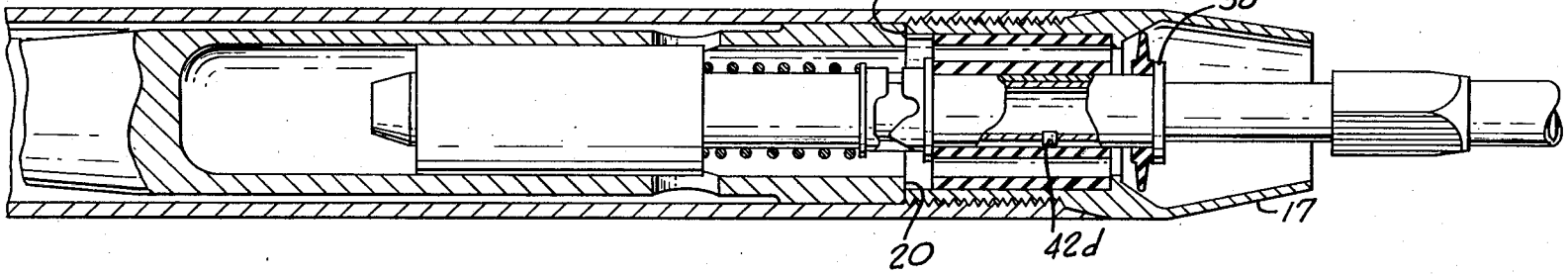
FIG. 4 is a sectional side view similar to FIGS. 2 and 3 but with the components in the position for causing reverse motion of the tool with the compressed air being supplied and the striker impacting the rear of the tool.
Figure 5:
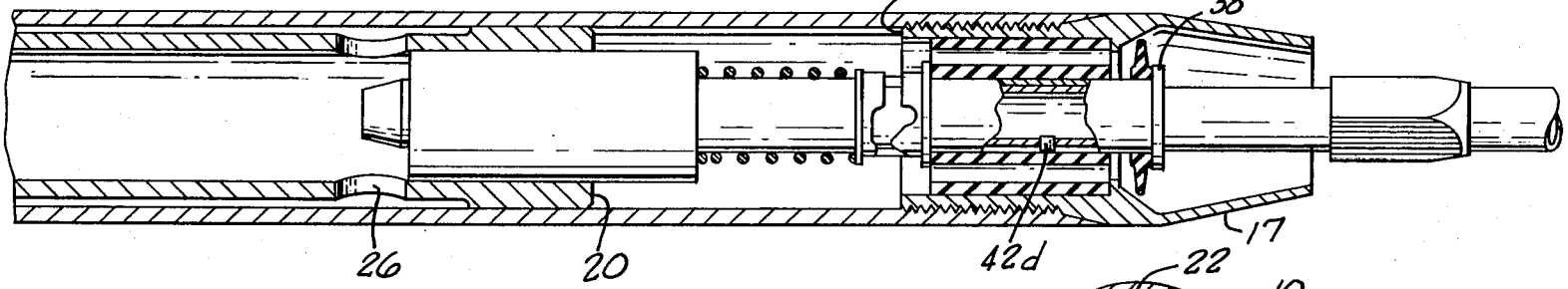
FIG. 5 is a sectional side view similar to FIG. 4 but illustrating the striker in the forward position.
Figure 6:
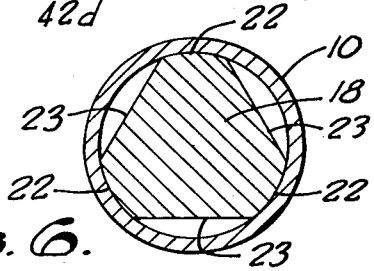
FIG. 6 is a sectional end view taken substantially on the Line 6—6 of FIG. 1.
Figure 7:
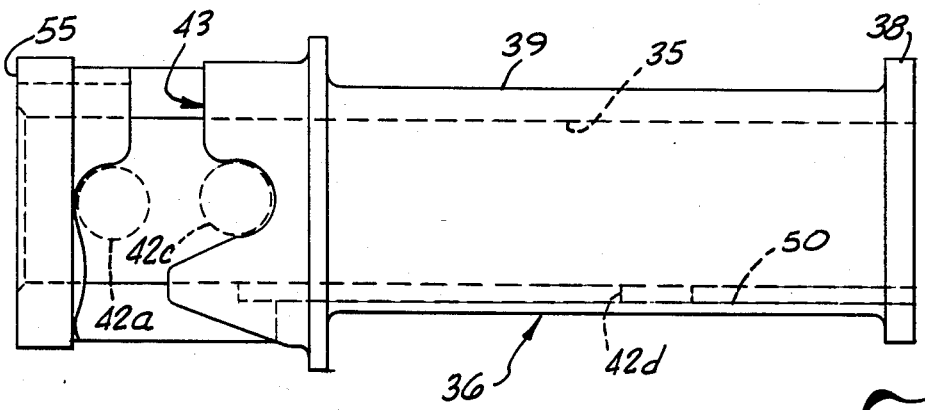
FIG. 7 is an enlarged elevation of the valve guide sleeve of the first embodiment.
Figure 8:
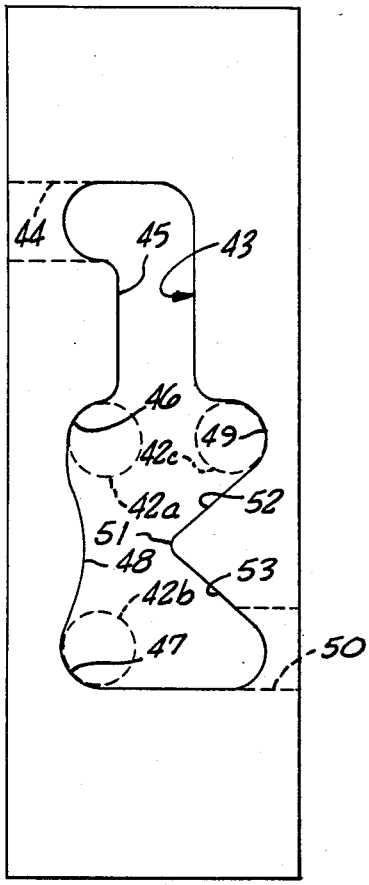
FIG. 8 is a developed view of the guide slots of the valve guide sleeve of FIG. 7.
Figure 9:
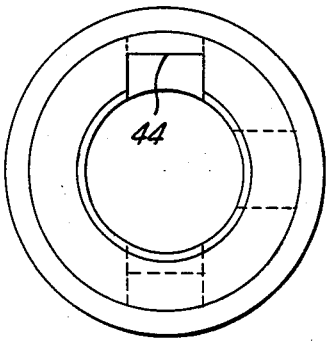
FIGS. 9 and 10 are end views of the left and right ends, respectively, of the valve guide sleeve of FIG. 7.
Figure 10:
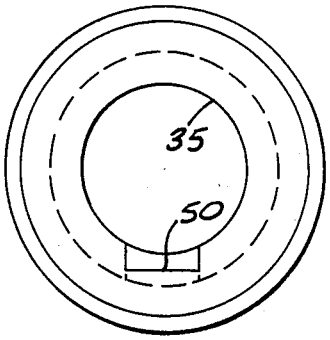

While in the forward operating mode, when the striker 18 is in the position shown in FIG. 1, the compressed air is supplied through the ports 26 to the entire front of the striker 18 forward of the piston surface 24 urging the striker rearwardly in its return stroke. However, as the ports 26 are closed the cavity 25 and valve element 31 form a piston and cylinder which is continually supplied with compressed air and therefore tends to arrest the rearward movement of the striker 18 in opposition to the compressed air previously admitted to the front of the striker. As the ports 26 pass the rear of the valve element 31 to thereby exhaust the compressed air previously trapped in front of the striker, the compressed air within the cavity 25 drives the striker 18 forwardly to impact surface 16 to complete the cycle. By moving the valve element 31 rearwardly, as shown in FIGS. 4 and 5, the compressed air is supplied through the ports 26 to the front of the striker 18 for a longer duration in the forward portion of the movement of the striker to develop a longer duration of rearward force and the ports 26 do not reach the rear end of the valve element 31 to exhaust the compressed air until immediately before the rear end 20 of the striker 18 impacts on the front end 21 of the end cap 17 thereby driving the tool rearwardly for the reverse mode of operation. This manner of operation of this reversible, pneumatic underground piercing tool, as thus far described, is the same for all three embodiments disclosed herein and is conventional as disclosed in many of the U.S. patents identified above and therefore will not be described in further detail. The present invention differs in the structure and manner for locating the valve element 31 in the two longitudinal positions for the forward and reverse modes of operation which structure and manner of operation will now be described with respect to each of the three embodiments disclosed herein.

In the embodiment of FIGS. 1 through 10, the valve body 30 has a cylindrical portion 34 extending from the rear end forwardly for a substantial proportion of the valve body 30. The cylindrical portion 34 is slidably received in the cylindrical interior 35 of a valve guide sleeve, generally designated 36, shown in detail in FIGS. 7–10. The valve guide sleeve 36 is supported in the end cap 17 by an elastomeric sleeve or bushing 37 which serves as a shock absorber and support for the valve guide sleeve 36. The elastomeric bushing 37 is stretched over the flange 38 on sleeve 36 and tightly fits the cylindrical outer surface 39 of sleeve 36. The bushing 37 in turn is press fit into the end cap 17 before assembling the end cap to the cylindrical body 10. The bushing 37 has a plurality of longitudinally extending holes 40 or other convenient shape through which the compressed air exhausts during the rearward stroke of the striker 18. A rubber valve seal 41 is also mounted on the valve guide sleeve 36 to the rear of the bushing 37 to cover the holes 40 and prevent dirt and other foreign material from entering the interior of the tool while allowing air to exhaust outwardly passed the seal 41 by deflecting same.

The valve body 30 is provided with a pin 42 extending outwardly of the cylindrical surface 34 and engaging a multiposition guide slot, generally designated 43, in the valve guide sleeve 36. As thus seen in the developed view FIG. 8 (meaning the 360° circumference of the forward portion of the valve guide sleeve 36 is drawn flat) the slot 43 includes a longitudinally extending internal entrance groove 44 connected to a circumferential groove 45 for assembling the valve guide sleeve 36 and valve body 30 by the pin 42 passing in through groves 44 and 45 of the slot 43 to the operative positions. The slot 43 includes angularly displaced depressions 46 and 47 separated by a raised portion 48 along the front edge of the slot 43 for locating the pin 42 in two separate positions 42*a* and 42*b*, respectively, shown in dashed lines in FIGS. 7 and 8. The opposite or rear edge of slot 43 is provided with a deep notch or depression 49 and a longitudinal internal groove 50 extending the length of the valve guide sleeve 36. The depression 49 and groove 50 are separated by a peak 51 with inclined ramp portions 52 and 53 on either side of the peak. The depression 49 provides a third position 42*c*, shown in dashed lines in FIGS. 7 and 8, for the pin 42 and the groove 50 allows the pin 42 to move longitudinally to a fourth position 42*d*, shown in dashed lines in FIG. 7 and in elevation in FIGS. 4 and 5. It should be noted that the pin 42 is of a limited height to pass through the internal grooves 44 and 50 but to engage the remaining edges of the slot 43.

A coil type compression spring 54 surrounds the mid portion of valve body 30 and extends between the rear shoulder of valve element 31 and the front end 55 of the valve guide sleeve 36 to continually urge the valve body 30 forwardly relative to the valve guide sleeve 36. After the valve body 30 has been assembled to the valve guide sleeve 36 by compressing the spring 54 and manipulating the components to cause the pin 42 to pass through grooves 44 and 45 to one of the positions 42*a* or 42*b*, the air hose 27 and connector 28 may be threadedly installed on the rear end of the valve body 30 and the end cap 17 threadedly installed on the cylindrical body 10 to complete the assembly. The spacing between the connector 28 and the rear end flange 38 of the valve guide sleeve 36 is such that the pin 42 may move to any of the positions 42*a–d* but cannot reenter the lateral groove 45 to pass through groove 44 to allow the pin 42 to exit the slot 43 and allow the valve body 30 to become disassembled from the valve guide sleeve 36. In operation of the tool, when the supply of compressed air is interrupted, the spring 54 urges the valve body 30 forwardly whereupon the pin 42 engages the front edge of slot 43 and assumes a condition such as shown in FIG. 3 with the pin in position 42*a*. By rotating the hose 27 in either direction the pin 42 will move between positions 42*a* and 42*b*. Upon supplying compressed air through hose 27 to the tool, the internal pressure will urge the valve body 30 outwardly (rearwardly) causing movement of the pin 42 from position 42*a* to position 42*c* or from position 42*b* to position 42*d*. If the pin 42 is located somewhere between positions 42*a* and 42*b*, the rearward movement will cause the pin to engage one of the slopes 52 or 53 on either side of the peak 51 to slightly rotate the valve body 30 and cause the pin 42 to assume one or the other of the rearward positions 42*c* or 42*d*.

With the pin 42 located in position 42*c* in depression 49, the valve element 31 is properly located for opening and closing the ports 26 on the striker 18 to cause the striker to impact the front of the tool for forward motion, as previously described. With the pin 42 located in the groove 50 at the position 42*d*, the valve element 31 is located in its rearmost position for properly opening and closing the ports 26 to cause the striker 18 to impact on the rear end cap 17 to cause rearward movement. In either mode of operation, the striker 18 does not impact against the opposite end but rather is arrested by compressed air. In other words, in the forward mode of operation the compressed air in cavity 25 produces a magnitude of force to slow the striker 18 and reverse its motion before the rear end 20 impacts against the end cap 17. Similarly, in the reverse mode of operation, the air trapped inside the cylindrical hollow body 10 in front of the striker 18 by closing of the ports 26 during forward motion of the striker slows the striker to a stop and reverses its motion without the front end 19 impacting on the surface 16 of anvil 15. Thus, all of the impacts are imposed in the proper direction for causing the desired movement of the tool depending on the position of the valve body 30.

With the aforedescribed structural arrangement, it may be seen that the direction of movement of the tool may be changed by merely interrupting the supply of compressed air and rotating the hose 27 approximately a quarter of a turn in the clockwise direction (as viewed from the rear of the tool) to position 42*a* of the pin for the forward mode of operation and a quarter of a turn in the counterclockwise direction to position 42*b* for the reverse mode of operation. Resumption of the supply of compressed air automatically moves the valve body 30 longitudinally to the proper position 42*c* or 42*d* as controlled by the pin 42 in slot 43.

Referring now to the second embodiment of the invention shown in FIGS. 11 through 16, many of the components are identical and will be so identified by the identical numeral without detailed description while other elements are similar and will be given the same numerals in the 100 series. Again, the striker 18 is slidably mounted in the hollow cylindrical body 10 to which is connected the end cap 17 supporting the elastomeric shock absorber bushing 37 which in turn supports a modified form of valve guide sleeve 136 in the rear of the underground piercing tool. The valve guide sleeve 136 has an elongated forward portion containing the entire multiposition guide slot, generally designated 143, which includes an entrance opening 144 for receiving the pin 142 during assembly of the valve body 130 to the valve guide sleeve 136. Further, the slot 143 includes a depression 146 for defining a forward position 142*a* for the pin and a deep notch or depression 149 longitudinally spaced therefrom for defining a second position 142*c* for the pin. A longitudinal groove 150 provides a third position 142*d* for the pin and again there are sloped portions 152 and 153 on either side of the peak 151 for causing the pin 142 to assume the position 142*c* or 142*d* upon the introduction of compressed air to the tool in a manner identical to that described with respect to the first embodiment. The remaining position 142*b*, shown in dashed lines in FIG. 15, for the pin is in an open portion of the slot 143 but the valve body 130 is prevented from moving further forward relative to the valve guide sleeve by a snap ring 160 on the rear end of the valve body 130 engaging the rear flange 138 on the valve guide sleeve 136. In this embodiment, the pin 142 may be substantially longer than in the first embodiment since it need not pass into a shallow longitudinal such as groove 50 in the valve guide sleeve 36. This provides greater resistance to wear of the pin 142 and slot 143. The operation of this second embodiment is identical to that of the first embodiment.

Referring now to the third embodiment of this invention shown in FIGS. 17 through 22, the components are installed in the end cap 17 which is then assembled to the hollow cylindrical body 10 (not shown) with striker 18 (not shown) and similar components will be described using numerals in the 200 series. Here the elastomeric shock absorbing bushing 37 is eliminated but a valve seal 41 (not shown) may be used if desired. The valve guide sleeve 236 has a radial flange portion 270 with an external diameter slightly smaller than the internal diameter of end cap 17 to allow some movement and misalignment. A support flange 271 has a collar portion 272 and an internal bore 273 for slidably receiving the external cylindrical surface 274 of the valve guide sleeve 236. A coil type compression spring 275 extends between the flanges 270 and 271 to perform a shock absorbing function. The flange portion 270 of valve guide sleeve 236 is held in position by a snap ring 276 and the rear support flange 271 has a spherical external surface 277 for engaging a similar internal spherical surface 278 on the end cap 17. The spring 275 is preloaded by an amount approximately equal to the reactive load created by the compressed air supply when the tool is in operation whereby, in effect, the forward force by the flange 270 on snap ring 276 by the spring 275 is reduced to approximately zero and therefore the assemblage of valve guide sleeve 36, support flange 271 and spring 275 somewhat "float" within end cap 17 during operation to allow for misalignment and to absorb the shocks caused by the impacting at each end.

This third embodiment incorporates a sound attenuating feature by providing the flanges 270 and 271 with a multiplicity of tapered holes 240 through which the escaping air passes. The holes 240 in flange 270 are misaligned with the holes 240 in flange 271 to inhibit the direct transmission of sound. Further, the holes 240 in flange 270 are tapered in the direction to cause contraction of the air while the holes 240 in flange 271 are tapered in the opposite direction to allow expansion of the air thereby attenuating the sound caused by the exhaust air.

Again, with this third embodiment as with the preceding embodiments, the valve guide sleeve 236 is provided with a multiposition slot, generally designated 243, that is engaged by a pin 242 on the valve body 230 for defining the position of the valve body 230 relative to the valve guide sleeve 236 and the balance of the tool. A deep notch or depression 249 defines the position for the pin in the forward operating mode of the tool and the longitudinal groove 255 defines the position for the pin for the reverse mode of operation. The pin 242 is confined to the slot 243 after assembly by the hose connector 28 adapted to engage the rear end 279 of the valve guide sleeve 236. Again, the manipulation required to cause reversing of the direction of movement of this third embodiment is the same as the two preceding embodiments, namely, merely interrupting the air pressure and rotating the air hose 27 in one direction or the other before resupplying compressed air.

Although I have described my invention in connection with three preferred embodiments, it is to be understood that the features from one embodiment may be incorporated in another and that the scope of my invention is not limited to the details of these embodiments but is of the full scope of the appended claims.

The invention claimed is:

1. In a reversible pneumatic underground piercing tool, an improved reversing valve mechanism comprising, an elongated tubular valve member having one end with means for connecting to a pneumatic hose for supplying compressed air and manipulating said valve member, means for supporting said valve member in the tool, and said supporting means and said valve member having interengaging means for guiding and restricting the movement of said valve member relative to said supporting means to two longitudinally and substantially spaced locations at two different predetermined angular positions less than 360° apart said interengaging means including means for guiding the valve member in substantially the same longitudinal position upon angular manipulation of the hose selectively in a clockwise and a counterclockwise direction for less than 360° of rotation for selectively positioning the valve member in one of said two predetermined angular positions and for allowing the supply of compressed air to cause sliding longitudinal movement of said valve member relative to said supporting means to a selected one of the two longitudinally and substantially spaced locations for in turn causing movement of said tool in a selected one of the directions.

2. In a reversible pneumatic underground piercing tool, an improved reversing valve mechanism comprising, an elongated tubular valve member having one end with means for connecting to a pneumatic hose for supplying compressed air and manipulating said valve member, a sleeve means movably supporting said valve member in the tool, said valve member and sleeve means having interengaging pin and slot means for guiding and restricting the movement of said valve member relative to said sleeve neans to two longitudinally spaced locations at two different predetermined angular positions less than 360° apart upon angular manipulation of the hose selectively in a clockwise and a counterclockwise direction for selective positioning in one of said two predetermined angular positions for causing movement of said tool in opposite directions, and means biasing said valve member in the longitudinal direction away from the said one end relative to said sleeve means.

3. The tool of claim 2 wherein said pin and slot means comprise a pin on the exterior of said valve member and a slot in said sleeve means.

4. The tool of claim 3 wherein said slot includes an entrance groove for assembling the valve member and sleeve means and two longitudinally spaced depressions at each angular position for receiving and positioning the said pin upon supplying or interrupting compressed air to said valve member in either of the two different angular positions.

5. The tool of claim 4 wherein said slot includes longitudinally and circumferentially inclined surfaces between the two angular positions of the pin for causing the pin to seal in one or the other depression.

6. The tool of claim 3 wherein the slot is located on a radially unobstructed wall portion of said sleeve means and the pin extends entirely through that wall portion.

7. The tool of claim 3 wherein the slot is located on an end portion of said sleeve means away from said one end and is open on that end, and abutment means on an extending end portion of said valve member and sleeve means toward said one end for limiting the longitudinal movement of said valve member relative to said sleeve means in a direction away from said one end by the biasing means to prevent the pin from becoming disengaged from said slot.

8. The tool of claim 3 wherein the slot includes an edge facing away from said one end with longitudinally and circumferentially inclined portions for causing the pin to be positioned in one or the other of the two longitudinally spaced locations by causing angular relative movement upon supplying compressed air unless the pin is aligned in one of the two angular positions.

9. The tool of claim 3 wherein said slot includes a depression in an edge facing toward said one end at the angular position for forward mode operation of the tool for positioning the pin therein upon interrupting the compressed air supply.

10. The tool of claim 2 wherein said sleeve means has a radially extending flange at one end and a flanged support collar at the other end with a compressing spring therebetween for supporting said sleeve means in shock absorbing relation in the tool.

11. The tool of claim 10 wherein said support collar is on the outer end of said sleeve means and has spherical seal engagement with the tool for accommodating misalignment and movement.

12. The tool of claim 10 wherein said flange and flange support each have longitudinally extending holes therethrough for the exhausting of compressed air.

13. The tool of claim 12 wherein said holes are circumferentially misaligned between the two flanges.

14. The tool of claim 12 wherein said holes are tapered.

15. The tool of claim 14 wherein the holes in the innermost flange have a converging taper and the holes in the outermost flange have a diverging taper in the direction of exhausting air flow.

16. In a reversible pneumatic underground piercing tool, an improved reversing valve mechanism having an elongated tubular valve member with one end having means for connecting to a pneumatic hose for supplying compressed air and manipulating said valve member and a guide sleeve supporting said valve member, the improvement comprising interengaging means on the guide sleeve and valve member for guiding and restricting the movement of the valve member relative to the guide sleeve to two longitudinally and substantially spaced locations at two different predetermined angular positions less than 360° apart said interengaging means for guiding the valve member in substantially the same longitudinal position upon angular manipulation of the hose selectively in a clockwise and a counterclockwise direction for less than 360° of rotation for selectively positioning the valve member in one of said two predetermined angular positions and for allowing the supply of compressed to cause sliding longitudinal movement of said valve member relative to said supporting means to a selected one of the two longitudinally and substantially spaced locations for in turn causing movement of said tool in a selected one of the directions, and means biasing the valve member in one longitudinal direction relative to the guide sleeve.

17. In a reversible pneumatic underground piercing tool, an improved reversing valve mechanism having an elongated tubular valve member with one end having means for connecting to a pneumatic hose for supplying compressed air and manipulating said valve member and a guide sleeve supporting said valve member, the improvement comprising interengaging means on the guide sleeve and valve member comprised of a pin on the valve member engaging a multiposition slot in the guide sleeve for guiding and restricting the movement of the valve member relative to the guide sleeve to two longitudinally spaced locations at two different predetermined angular positions less than 360° apart upon angular manipulation of the hose selectively in a clockwise and a counterclockwise direction for selective positioning in one of said two predetermined angular positions for causing movement of said tool, in opposite directions, and means biasing the valve member in one longitudinal direction relative to the guide sleeve.

18. In a reversible pneumatic underground piercing tool, an improved reversing valve mechanism having an elongated tubular valve member with one end having means for connecting to a pneumatic hose for supplying compressed air and manipulating said valve member and a guide sleeve supporting said valve member, the improvement comprising interengaging means on the guide sleeve and valve member for guiding and restricting the movement of the valve member relative to the guide sleeve to two longitudinally spaced locations at two different predetermined angular positions less than 360° apart upon angular manipulation of the hose selectively in a clockwise and a counterclockwise direction for selective positioning in one of said two predetermined angular positions for causing movement of said tool in opposite directions, and means biasing the valve member in one longitudinal direction relative to the guide sleeve, wherein said interengaging means define four positions for the valve member relative to the guide, namely, two angularly displaced and inward positions caused by interrupting the compressed air supply and the biasing means, and two angularly and longitudinally displaced outward positions caused by the compressed air supply compressing the biasing means and urging the valve member outwardly.

19. The tool of claim 18 wherein the angular displacement between each of the two inward and the two outward positions is less than 360° .

20. The tool of claim 19 wherein said angular displacement is approximately 90° .

21. The tool of claim 18 wherein said interengaging means comprise a pin on the valve member and a slot on the guide sleeve.

22. In a reversible pneumatic underground piercing tool that employs an elongated and hollow cylindrical body with a tapered front end and an open rear end, a striker slidably positioned in the body to reciprocate to strike the front end of the body to cause forward movement and to strike the rear end to cause rearward movement, the striker having a hollow rear end, a tubular elongated valve movably mounted in the rear end of the cylindrical body and extending into the hollow rear end of the striker, the rear end of the valve having means for connecting to a supply of compressed air, the valve and striker having cooperating means for controlling the passage of compressed air to the front and rear of the striker for causing reciprocation and striking the front or rear depending on the longitudinal position of the valve, the, improvement comprising, means in the rear end of the cylindrical body for supporting the valve to absorb shock and allow restricted angular movement including sleeve means within which the valve is turnably and slidably supported, cooperating slot and pin means on said sleeve means and valve for restricting the longitudinal position of the valve to a forward location in one angular position of the valve relative to the sleeve means and to a rearward location in another angular position, and said two angular positions being less than 360° apart and at clockwise and counterclockwise extreme locations of normal rotation of said valve relative to said sleeve means.

23. The tool of claim 22 wherein a biasing means urges the valve toward the front end in opposition to the compressed air forces and upon interrupting the compressed air supply moves the valve to a longitudinal position for allowing shifting of the valve to one of the two locations upon renewed supply of compressed air.

24. The tool of claim 22, wherein said supporting means includes a metal coil-type compression spring for shock absorbing.

25. The tool of claim 22 wherein said supporting means includes taper holes for the passage of exhausted air, and said holes arranged to attenuate the sound of the exhausting air.

26. A reversible pneumatic underground piercing tool comprising, an elongated and hollow cylindrical body with a tapered front end and an open rear end, a striker slidably positioned in said body to reciprocate for striking the front end of the body to cause forward movement and striking the rear end to cause rearward movement, said striker having a hollow rear end, a tubular elongated valve movably mounted in the rear end of said cylindrical body and extending into said hollow rear end of said striker, said valve having an outwardly extending rear end with means for connecting to a hose for the supply of compressed air, said valve and striker having cooperating means for controlling the passage of compressed air to the front and rear of the striker for causing reciprocation and striking the front or rear depending on the longitudinal position of the valve, means in the rear end of the cylindrical body for supporting said valve for absorbing shock and allowing restricted angular movement including sleeve means within which the valve is rotatably and slidably supported, cooperating slot and pin means on said sleeve means and valve for restricting the longitudinal position of the valve to a forward location in one angular position of the valve relative to the sleeve means and to a rearward location in another angular position during the supply of compressed air, and said two angular positions being less than 360° apart and at clockwise and counterclockwise extreme locations of normal rotation of said valve relative to said sleeve means.

27. A reversible underground piercing tool operable by a pneumatic hose supplying compressed air thereto, comprising, an elongated body, a striker slidably mounted in the body, a valve means engaging and cooperating with the striker for a controlled supply of compressed air for causing reciprocation of the striker, means for connecting the valve means to the hose, a sleeve means mounted in said body and slidably and rotatably supporting said valve means, slot means and pin means on said valve means and sleeve means for restricted and controlled relative movement among predetermined positions including first and second positions at angularly spaced locations of less than 360° and longitudinally substantially equal locations, a third location longitudinally spaced a substantial distance from and angularly aligned with the first location for operating the tool in a forward direction, and a fourth position angularly aligned with and spaced only a short distance from the second position for operating the tool in the reverse direction.

28. The reversible tool of claim 27 wherein means are provided for urging the valve means and sleeve means into one of said first and second positions upon the interruption of compressed air supply for allowing movement between said first and second positions by angular rotation of the hose.

29. The reversible tool of claim 27 wherein cam surface means are provided in said slot means between said first and second positions and between said third and fourth positions for causing said pin means to move angularly to align with one of said positions upon axial movement of said pin means in either direction.

30. The reversible tool of claim 27 wherein means are provided for limiting the relative angular movement between said valve means relative to said sleeve means to the first and third positions, in one angular direction and to the second and fourth positions in an opposite angular direction.

* * * * *